US008496255B2

(12) United States Patent
Rouweler

(10) Patent No.: US 8,496,255 B2
(45) Date of Patent: Jul. 30, 2013

(54) CLAMPING BEAM

(75) Inventor: Franciscus Wilhelmus Rouweler, Arnhem (NL)

(73) Assignee: Wila B.V., Lochem (NL)

( * ) Notice: Subject to any disclaimer, the term of this patent is extended or adjusted under 35 U.S.C. 154(b) by 1306 days.

(21) Appl. No.: 12/101,604

(22) Filed: Apr. 11, 2008

(65) Prior Publication Data

US 2008/0252024 A1 Oct. 16, 2008

(51) Int. Cl.
*B21D 37/04* (2006.01)
*B23Q 3/00* (2006.01)

(52) U.S. Cl.
USPC ..... 279/119; 279/110; 279/121; 279/137; 72/482.91; 72/482.92

(58) Field of Classification Search
USPC ..... 279/119, 110, 121, 137, 82; 72/481.1, 72/481.3, 481.4, 482.3, 482.6, 482.91–482.94
IPC ..... B21D 37/04; B23Q 3/00
See application file for complete search history.

(56) References Cited

U.S. PATENT DOCUMENTS

| | | | | |
|---|---|---|---|---|
| 3,656,773 | A * | 4/1972 | Blattry et al. | 279/121 |
| 4,315,425 | A | 2/1982 | Zbornik et al. | |
| 5,245,854 | A * | 9/1993 | Bruggink et al. | 72/481.7 |
| 6,000,273 | A * | 12/1999 | Stover | 72/482.3 |
| 6,003,360 | A * | 12/1999 | Runk et al. | 72/482.2 |
| 6,732,564 | B2 * | 5/2004 | Runk et al. | 72/481.1 |
| 6,928,852 | B2 * | 8/2005 | Enderink | 72/481.1 |
| 7,152,453 | B2 * | 12/2006 | Johnson et al. | 72/481.1 |
| 7,308,817 | B2 * | 12/2007 | Shimota et al. | 72/482.1 |
| 7,632,224 | B2 * | 12/2009 | Rouweler et al. | 483/28 |
| 7,634,935 | B2 * | 12/2009 | Mazzocchi | 72/482.91 |
| 7,721,586 | B2 * | 5/2010 | Pabich et al. | 72/481.1 |
| 7,810,369 | B2 * | 10/2010 | Rouweler et al. | 72/482.1 |
| 8,099,992 | B2 * | 1/2012 | Rouweler et al. | 72/481.2 |
| 2003/0033846 | A1 * | 2/2003 | Runk et al. | 72/481.1 |
| 2004/0187552 | A1 * | 9/2004 | Enderink | 72/481.1 |
| 2005/0000267 | A1 * | 1/2005 | Harrington et al. | 72/481.1 |
| 2005/0132772 | A1 * | 6/2005 | Harrington et al. | 72/481.1 |
| 2006/0174679 | A1 * | 8/2006 | Pabich et al. | 72/481.1 |
| 2006/0174680 | A1 * | 8/2006 | Shimota et al. | 72/481.2 |
| 2006/0191313 | A1 * | 8/2006 | Harrington et al. | 72/482.92 |

FOREIGN PATENT DOCUMENTS

| | | | |
|---|---|---|---|
| FR | 2818189 | A1 | 6/2002 |
| JP | 62267019 | A | 11/1987 |
| JP | 10249439 | A | 9/1998 |

* cited by examiner

*Primary Examiner* — David Bryant
*Assistant Examiner* — Bayan Salone
(74) *Attorney, Agent, or Firm* — The Webb Law Firm

(57) ABSTRACT

The invention relates to a clamping system for clamping a number of tools wherein said system comprises:

a body;

an elongated groove arranged in the body for reception of a clamping part of at least one tool;

at least one pusher element extendable into the groove for pushing the clamping part of a tool against a wall of the groove;

wherein shape imposed displacement means for displacing the at least one pusher element from a first position substantially freeing the groove, enabling insertion of the clamping part of a tool into the groove, towards a second position, in which the at least one pusher element extends into the groove.

11 Claims, 4 Drawing Sheets

CLAMPING BEAM

The invention relates to a clamping system for clamping a number of tools wherein said system comprises:

a body;

an elongated groove arranged in the body for reception of a clamping part of at least one tool;

at least one pusher element extendable into the groove for pushing the clamping part of the tool in at least one direction against at least one wall of the groove.

Such clamping systems are well-known, for example for use in bending machines, like press brakes swivel bending brakes, or folding presses. It is common to insert tools into the clamping system of a bending machine and clamp the tools in the clamping system. For clamping the clamping parts of the tools, a pusher element is extended into the groove such that the clamping part of the tool is pushed against a wall of the groove and therewith clamped. The force necessary to extend the pusher element into the groove is commonly derived from pressurized air. It is known to incorporate a bellow into the clamping system which after filling the bellow with pressurized air, pushes the pusher element into the groove. It is also known to use a hydraulic pressure to clamp the tools into the clamping system.

The advantage of such a conventional system is that all tools arranged in the clamping system can be clamped all at once, by a central control.

Other systems are known for clamping tools onto a device, such as a bending machine, but with these systems each tool has to be clamped separately by for example tightening a bolt or operating an excenter. Such clamping systems are furthermore limited to a clamping width of about 150 mm-200 mm. When using longer tools, more separate clamps have to be tightened, before such a tool is clamped safely.

The disadvantage of systems using pressurized air or a hydraulic fluid is that a compressor is necessary to provide the pressurized air or the pressurized hydraulic fluid. Especially for smaller devices having a clamping system such an additional arrangement increases costs and is not always directly available.

It is therefore an object of the invention to provide a clamping system, which has the advantages of clamping systems using pressurized air or hydraulic fluid in particular the advantage of the operation of the clamping by a central control, but which do not have the related disadvantages or at least has only part of these disadvantages.

This object is achieved by a clamping system according to the invention, which is characterized by shape imposed displacement means, for displacing the at least one pusher element from a first position substantially freeing the groove, enabling insertion of the clamping part of a tool into the groove, towards a second position, in which the at least one pusher element extends into the groove.

Operation of the displacement means enable a central control with which all the pusher elements can be operated at once.

The shape imposed displacement means make it possible to move the pusher element from a first position to a second position. The shape imposed displacement means must be understood as means which move the pusher element based on the shape of the displacement means. This is in contrast to displacement means used in conventional clamping systems, which use pressurized air or hydraulic fluid. Displacement of a pusher element is not guaranteed when pressurized air is arranged onto the pusher element. With a shape imposed displacement means the position of the shape dictates the position of the pusher element. So there is always a direct feedback between the position of the shape imposed displacement means and the pusher element.

In an embodiment of the clamping system according to the invention, the clamping system further comprises central control means for operating the shape imposed displacement means. With these central control means it is possible to operate the shape imposed displacement means such that all tools arranged in the elongated groove are clamped all at once. This avoids the need for tightening for example a bolt for each tool, as is common in the prior art.

In a preferred embodiment of the clamping system according to the invention, the shape imposed displacement means comprise at least one pair of wedge shaped elements, wherein the wedge shaped elements shift along each other, and are arranged between the body and the at least one pusher element.

With wedge shaped elements it is possible to generate a high force onto the at least one pusher element, while the force necessary to shift the wedge shaped elements along each other can be kept low.

In a further preferred embodiment of the clamping system according to the invention, the central control means comprise:

a housing arranged to one of the wedge shaped elements;

an axle rotatably arranged in the housing by a thread and extending in the direction of the wedge shaped elements; and a lever rotatably arranged to the body such that by operating the lever, the axle is moved in longitudinal direction and/or rotated along the longitudinal axis.

With such a control means it is possible to move the wedge shaped elements over a long distance just by pivoting the lever such that the axle is moved in longitudinal direction and then a force can be built up by the wedge shaped elements by rotating the axis which moves the wedge shaped elements even further, generating a high clamping force, to the position in which the tools are safely clamped.

In another preferred embodiment of the clamping system according to the invention, the control means comprise:

an axle rotatably arranged in the body and extending in the direction of the wedge shaped elements;

a first sleeve rotatably arranged relative to the axle by a first thread; and a second sleeve rotatably arranged relative to the first sleeve by a second thread and connected to one of the wedge shaped elements, wherein the pitch of the first thread differs substantially from the pitch of the second thread.

When rotating the axle, rotation will occur along the thread having generally the largest pitch. This results in a quick displacement over a distance of the wedge shaped elements towards a position in which the wedge shaped elements clamp the tools. As soon as the wedge shaped elements start up building pressure to clamp the tools, rotation will occur around the other thread having the smaller pitch. Due to the smaller pitch it is possible to generate at the wedge shaped elements a high clamping force for clamping the tools into the clamping system.

Preferably the first sleeve comprises a flange for limiting the movement of the second sleeve, relative to the first sleeve. This avoids the possibility that the second sleeve runs off from the first sleeve.

In another embodiment of the clamping system according to the invention, the shape imposed displacement means comprise a camshaft with at least one cam on which the at least one pusher element abuts.

Also with a camshaft it is possible to generate a high force on the pusher elements, while the force necessary for rotating the camshaft is kept low.

In still another embodiment of the clamping system according to the invention, in combination with the embodiments having a central control means, the control means comprise a lever arranged on the camshaft. With such a lever it is possible to rotate the camshaft and operate the pusher elements.

In yet another embodiment of the clamping system according to the invention, the at least one pusher element comprises a pin extendable into the groove and a first spring arranged between the pin and the shape imposed displacement means.

With the spring it is possible to absorb small dimensional differences, ensuring a maximum clamping force of the pin onto the tool. In yet another embodiment of the clamping beam according to the invention the at least one pusher element further comprises a second spring arranged between the body and the pin for urging the pusher element towards the first position. This second spring ensures that the pusher elements are retracted to the first position clearing the groove, such that the clamping part of the tools can be easily inserted or extracted from the groove.

In a further embodiment of the clamping system according to the invention the end of the pin extending into the groove is provided with a shaped surface suitable for cooperating with a groove in the clamping part of the tool for pushing the tool into the groove of the clamping system.

It is clear that operating of the shape imposed displacement means may take place by the central control means described above, but it is also possible to have an hydraulic cylinder providing the movement for the wedge shaped elements or the rotation for the camshaft. Other possibilities include an electric motor or other drive means.

Furthermore, the disclosed clamping system according to the invention is able to clamp any kind of tooling. In case of a bending machine like press brakes or swivel bending brakes American style tooling, European style tooling, New Standard tooling or any other type of bottom or top tooling can be clamped in the clamping system according the invention.

These and other advantages of the invention will be elucidated in conjunction with the accompanying drawings.

FIG. 3 shows a cross-sectional view of a second embodiment of the clamping system according to the invention in a clamping position.

Figure 1:
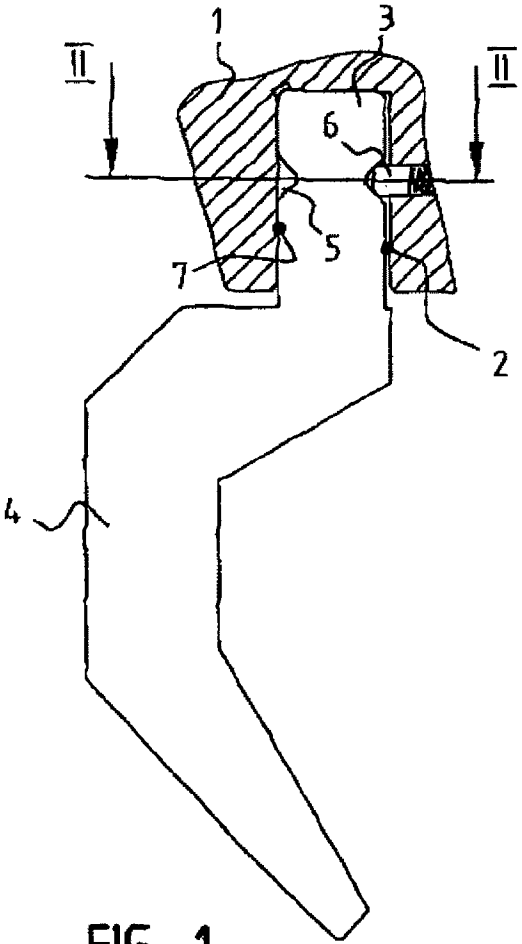
FIG. 1 shows a cross-sectional view of a first embodiment of a clamping system according to the invention.

FIG. 1 shows a cross-sectional view of a clamping system 1 having a groove 2 in which a clamping part 3 of a tool 4 is arranged. The clamping part 3 of the tool has V-shaped notches 5 in which a pin 6 is pushed in order to clamp the tool 4. The pin 6 is extended into the groove 2 and as a result the clamping part 3 is pushed against the wall 7 of the groove 2.

Figure 2A:
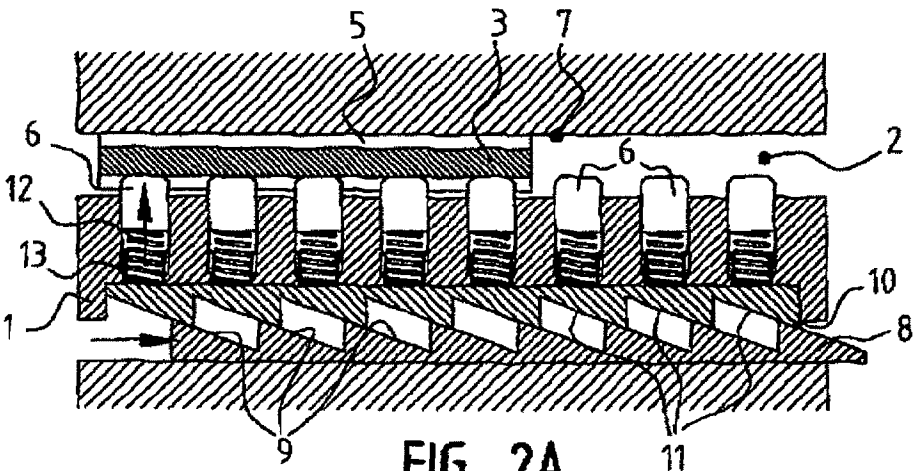
FIGS. 2A and 2B show a cross-sectional view along the lines II-II in FIG. 1 in a clamping position and a position freeing the groove.

FIG. 2A is a cross-sectional view along the lines II-II in FIG. 1. The pins 6 are guided in the body of the clamping system 1. In the clamping system 1 a first rack a with wedges 9 is slidably arranged in the clamping system 1. A second rack 10 having wedges 11 is placed next to the rack 8 such that the wedges 9 and 11 work together. By shifting the rack 8 to the right as shown in FIG. 2A, the rack 10 is pushed away in transverse direction and as a result the pins 6 are extended into the groove 2, where they clamp the clamping part 3 of tool 4.

Each pin 6 is part of a pusher element. Such a pusher element further comprises a spring 12 and a cup 13, which is in direct contact with rack 10. The spring 12 compensates for differences in dimension for example of the groove, the clamping part 3 or the pins 6.

Figure 2B:
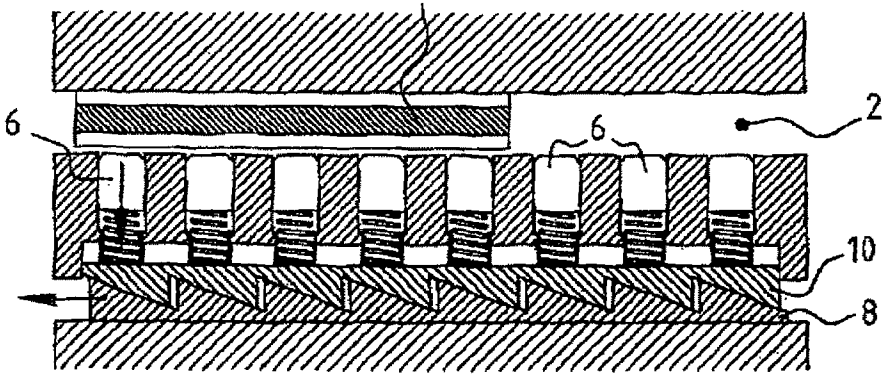

In FIG. 2B the rack 8 is slided to the left in FIG. 2B as a result of which rack 10 approaches rack 8 and the pins 6 are retracted from the groove 2 freeing the clamping part 3 of the tool 4 such that it can be retracted from the groove 2 and eventually another tool can be inserted into the groove 2.

FIG. 3 shows a variation to the clamping system 1 of FIGS. 1 and 2. The same elements have been designated with the same reference numerals.

Each pin 6 is provided with a flange 14 which prevents the pin 6 to be pushed completely in groove 2. A second spring 15 has been arranged to retract pin 6 from the groove 2, when the rack 8 is shifted such that the rack 10 approaches rack 8.

Figures 3A, 3B, 4, 5:
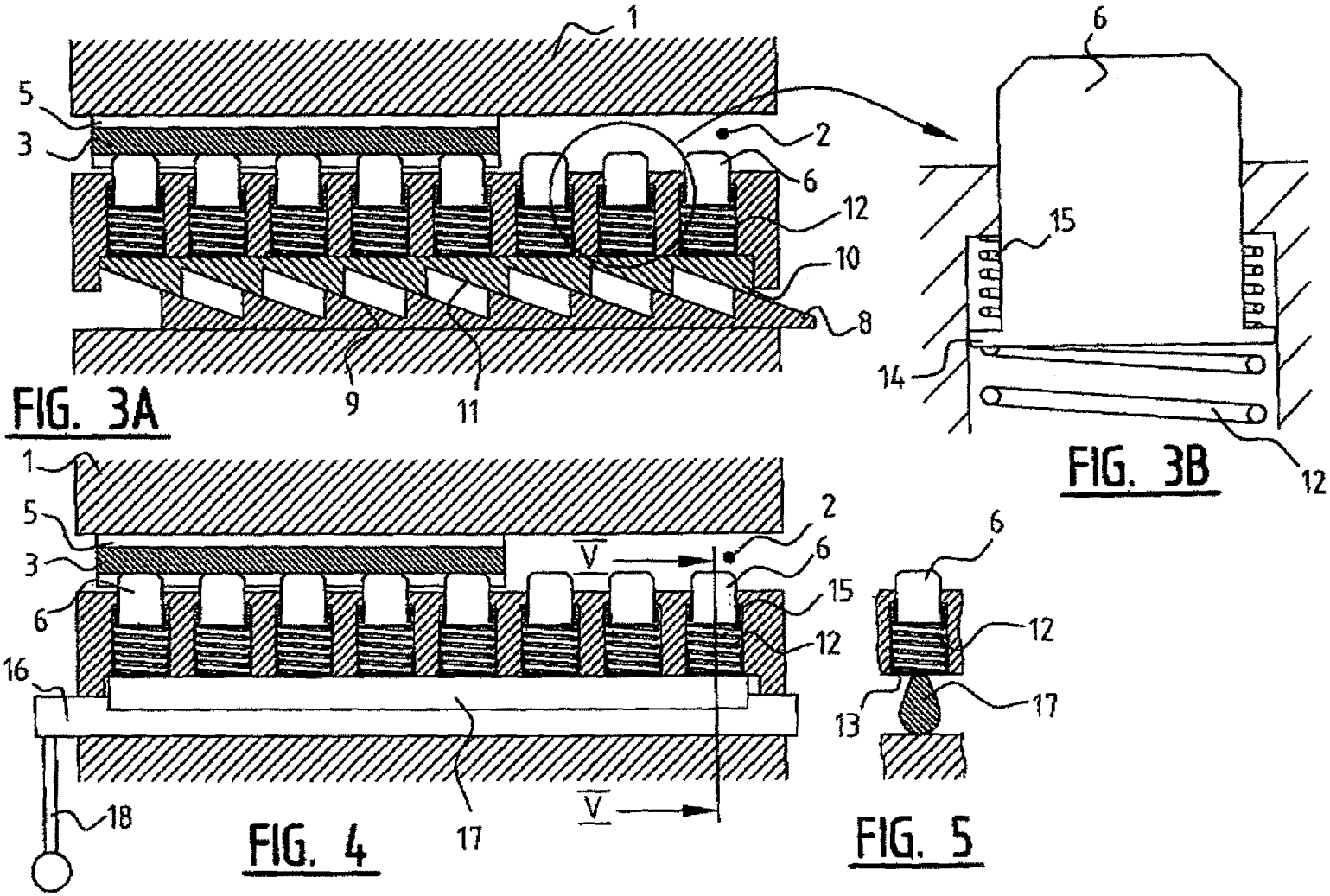
FIG. 4 shows a third embodiment of a clamping system according to the invention.
FIG. 5 shows a cross-sectional view along the line V-V in FIG. 4.

In FIG. 4 a third embodiment is shown, which has features in common with the embodiment according to FIG. 3. These same features have been designated with the same reference numerals. Instead of a rack 8, 10 with wedges 9, 11 a shaft 16 is provided on which a cam 17 is arranged (see also FIG. 5), A lever 18, being a central control means is arranged to the shaft 16 to rotate the shaft. By rotating the shaft 16 the pins 6 can be moved into the groove 2 or be retracted from said groove 2.

Figure 6:
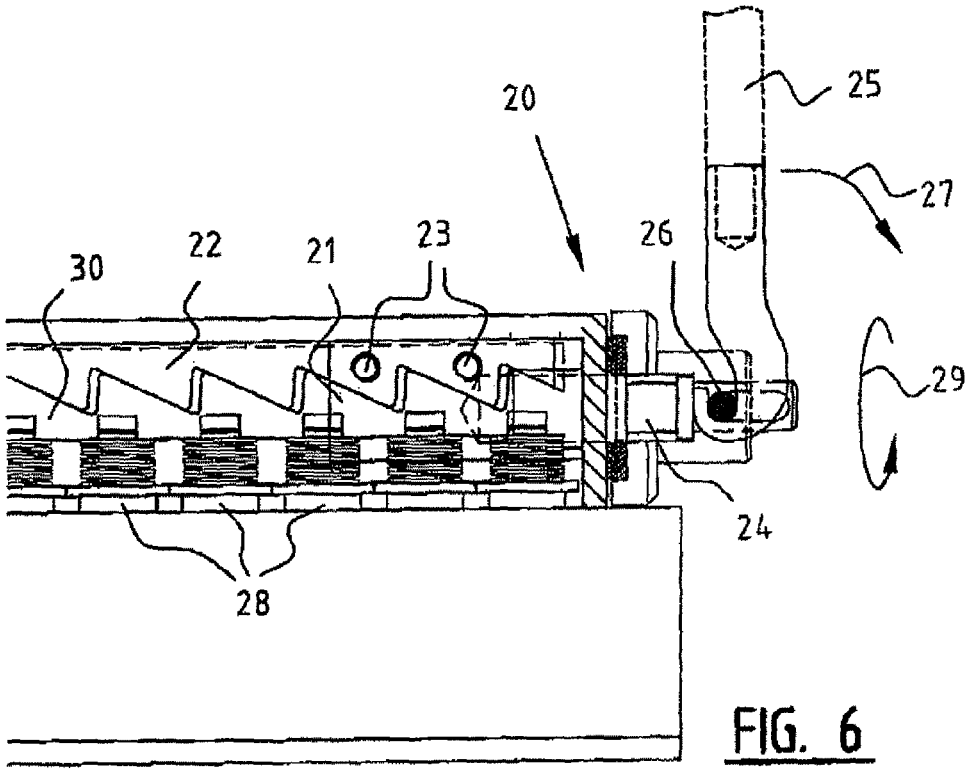
FIG. 6 shows a central control for operating the displacement means.

In FIG. 6 a central control means 20 is shown in cross-sectional view. This central control means 20 comprise a housing 21, which is arranged to the rack 22 provided with wedges by bolt 23. An axle 24 is rotatably arranged in the housing 21. A lever 25 is rotatably arranged along a pin 26 and is furthermore rotatably around the longitudinal axis of axle 24.

By rotating the lever 25 in the direction of the arrow 27 a quick displacement of the axle 24 is achieved moving the rack 22 to the left as shown in FIG. 6.

In order to achieve a pressure build up on the pusher elements 28 the lever 25 is then rotated along the longitudinal axis of the shaft 24 in the direction of the arrow 29. As the axle 24 is arranged by a thread into the housing 21 a small displacement is achieved, providing in combination with the wedges of the rack 22 and rack 30 a pressure build up enabling the clamping system to clamp tools.

Figure 7A:
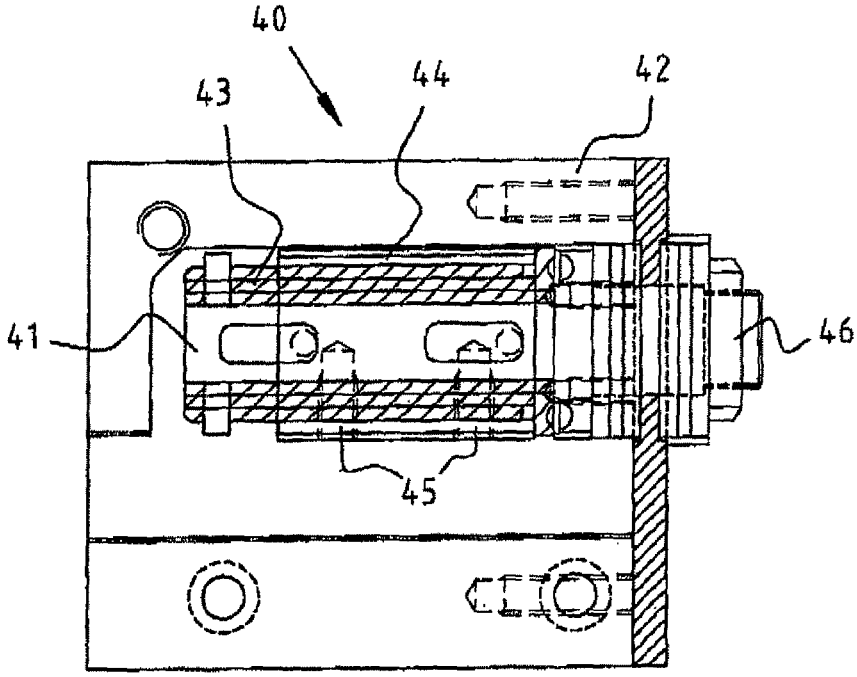
FIGS. 7A-7C show another embodiment of a central control in different positions.
Figure 7B:
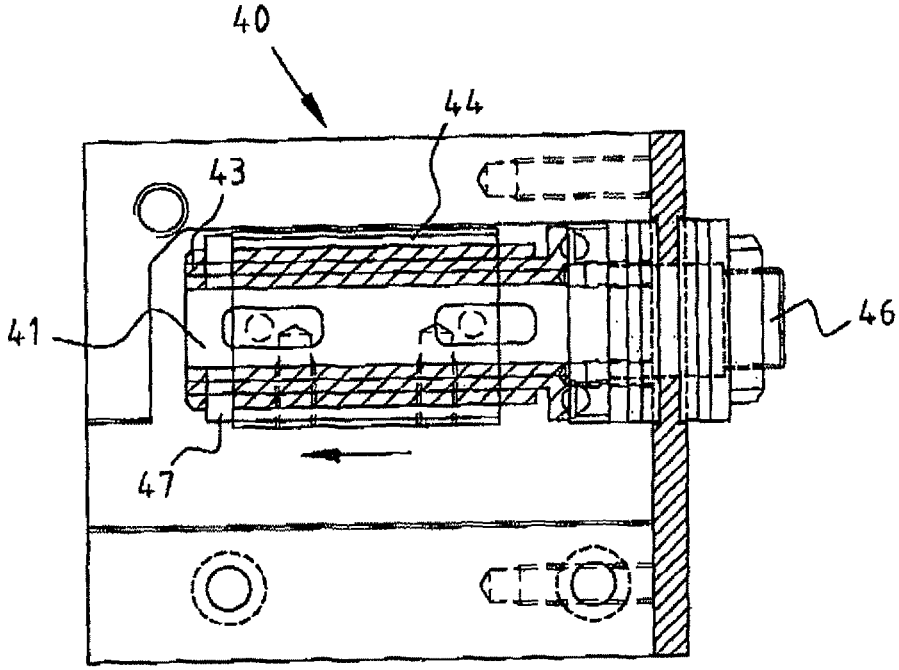
Figure 7C:
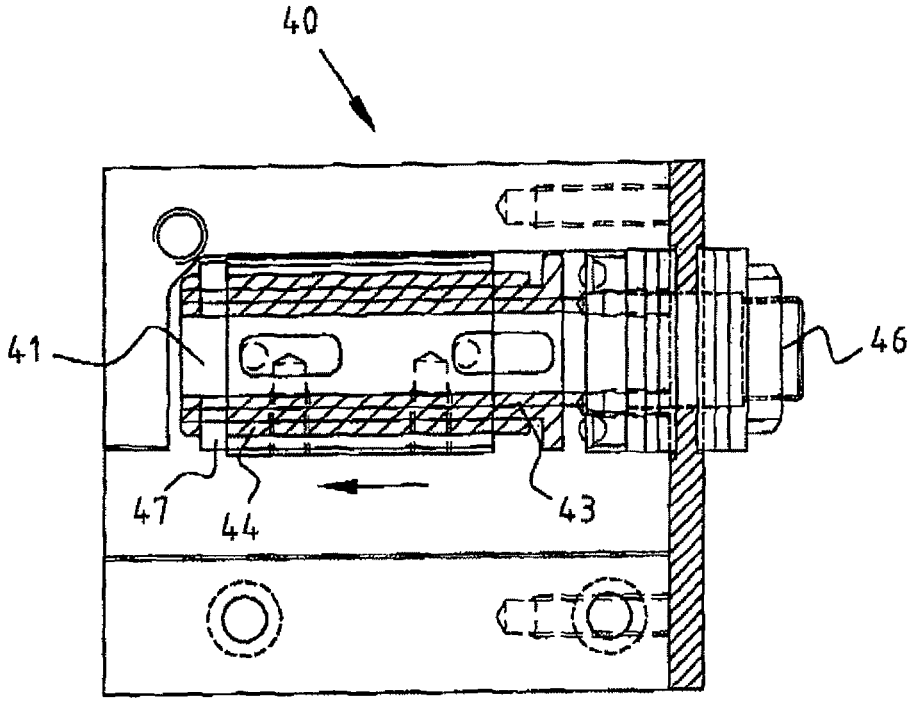

In FIGS. 7A-7C another embodiment of a central control 40 is shown in different positions. This central control 40 comprises an axle 41, which is rotatably arranged in the body 42 of a clamping system according to the invention. On the axle 41 a first thread is arranged on which a sleeve 43 is rotatably arranged. This sleeve 43 is in turn arranged with a second thread on which a second sleeve 44 is rotatably arranged. The second sleeve 44 is provided with threaded holes 45 to which a rack with wedges can be arranged. The shaft 41 can be driven by insertion of a hexkey into the hole 46.

In this example, the pitch of the second thread on the first sleeve 43 is larger than the pitch of the first thread onto the axle 41. Now when rotating the axle 41 the second sleeve 44 will move to the left in the drawing as a result of the friction differences between the first and second thread. This friction difference can also be provided by design, for example by prestressing the first thread. When the second sleeve 44 reaches its end position defined by the flange 47 and by continued rotation of the axle 41 the first sleeve 43 starts to move to the left as a result of the abutment of the second sleeve 44 against the flange 47. As the pitch of the thread on the axle 41 is smaller than the pitch of the thread on the first sleeve 43, a pressure can be built up which is exerted by the wedges and corresponding pins.

The invention claimed is:

1. A clamping system for clamping a number of tools, said system comprising:

a body;

an elongated groove arranged in the body for reception of a clamping part of at least one tool;

at least one pusher element extendable and retractable from the body and into the groove for pushing the clamping part of a tool against a wall of the groove; and a shape imposed displacement mechanism operatively engaging the at least one pusher element to displace the at least one pusher element from a first position retracted within the body and substantially freeing the groove, enabling insertion of the clamping part of a tool into the groove, towards a second position, in which the at least one pusher element extends from the body into the groove, wherein the shape imposed displacement mechanism comprises at least one pair of wedge shaped elements, and wherein the wedge shaped elements shift along each other and are arranged between the body and the at least one pusher element, wherein the at least one pusher element comprises a pin extendable into the groove and a first spring arranged between the pin and the at least one pair of wedge shaped elements of the shape imposed displacement mechanism, and wherein at least one of the wedge shaped elements directly engages the first spring.

2. The clamping system according to claim 1, further comprising a central control mechanism for operating the shape imposed displacement mechanism.

3. The clamping system according to claim 1, further comprising a central control mechanism for operating the shape imposed displacement mechanism, wherein the central control mechanism comprises:

a housing arranged to one of the wedge shaped elements;

an axle rotatably arranged in the housing by a thread and extending in the direction of the wedge shaped elements; and a lever rotatably arranged to the body such that by operating the lever, the axle is moved in a longitudinal direction and/or rotated along the longitudinal axis.

4. The clamping system according to claim 1, further comprising a central control mechanism for operating the shape imposed displacement mechanism, wherein the central control mechanism comprises:

an axle rotatably arranged in the body and extending in the direction of the wedge shaped elements;

a first sleeve rotatably arranged relative to the axle by a first thread; and a second sleeve rotatably arranged relative to the first sleeve by a second thread and connected to one of the wedge shaped elements, wherein the pitch of the first thread differs substantially from the pitch of the second thread.

5. The clamping system according to claim 4, wherein the first sleeve comprises a flange for limiting the movement of the second sleeve, relative to the first sleeve.

6. The clamping system according to claim 1, wherein the at least one pusher element further comprises a second spring arranged between the body and the pin for urging the pusher element towards the first position.

7. The clamping system according to claim 1, wherein the end of the pin extending into the groove is provided with a shaped surface suitable for cooperating with the clamping part of the tool for pushing the tool into the groove.

8. A clamping system for clamping a number of tools, said system comprising:

a body;

an elongated groove arranged in the body for reception of a clamping part of at least one tool;

at least one pusher element extendable into the groove for pushing the clamping part of a tool against a wall of the groove;

a shape imposed displacement mechanism for displacing the at least one pusher element from a first position substantially freeing the groove, enabling insertion of the clamping part of a tool into the groove, towards a second position, in which the at least one pusher element extends into the groove; and a central control mechanism for operating the shape imposed displacement mechanism, wherein the shape imposed displacement mechanism comprises at least one pair of wedge shaped elements, and wherein the wedge shaped elements shift along each other and are arranged between the body and the at least one pusher element, and wherein the central control mechanism comprises:

a housing arranged to one of the wedge shaped elements;

an axle rotatably arranged in the housing by a thread and extending in the direction of the wedge shaped elements; and a lever rotatably arranged to the body such that by operating the lever, the axle is moved in a longitudinal direction and/or rotated along the longitudinal axis.

9. A clamping system for clamping a number of tools, said system comprising:

a body;

an elongated groove arranged in the body for reception of a clamping part of at least one tool;

at least one pusher element extendable into the groove for pushing the clamping part of a tool against a wall of the groove;

a shape imposed displacement mechanism for displacing the at least one pusher element from a first position substantially freeing the groove, enabling insertion of the clamping part of a tool into the groove, towards a second position, in which the at least one pusher element extends into the groove; and a central control mechanism for operating the shape imposed displacement mechanism, wherein the shape imposed displacement mechanism comprises at least one pair of wedge shaped elements, and wherein the wedge shaped elements shift along each other and are arranged between the body and the at least one pusher element, and wherein the central control mechanism comprises:

an axle rotatably arranged in the body and extending in the direction of the wedge shaped elements;

a first sleeve rotatably arranged relative to the axle by a first thread; and a second sleeve rotatably arranged relative to the first sleeve by a second thread and connected to one of the wedge shaped elements, wherein the pitch of the first thread differs substantially from the pitch of the second thread.

10. The clamping system according to claim 9, wherein the first sleeve comprises a flange for limiting the movement of the second sleeve, relative to the first sleeve.

11. A clamping system for clamping a number of tools, said system comprising:

a body;

an elongated groove arranged in the body for reception of a clamping part of at least one tool;

at least one pusher element extendable into the groove for pushing the clamping part of a tool against a wall of the groove; and a shape imposed displacement mechanism for displacing the at least one pusher element from a first position substantially freeing the groove, enabling insertion of the clamping part of a tool into the groove, towards a second position, in which the at least one pusher element extends into the groove, wherein the at least one pusher element comprises a pin extendable into the groove and a first spring arranged between the pin and the shape imposed displacement mechanism, and wherein the at least one pusher element further comprises a second spring arranged between the body and a flange on the pin for urging the pusher element towards the first position.

* * * * *

UNITED STATES PATENT AND TRADEMARK OFFICE

CERTIFICATE OF CORRECTION

PATENT NO. : 8,496,255 B2
APPLICATION NO. : 12/101604
DATED : July 30, 2013
INVENTOR(S) : Franciscus Wilhelmus Rouweler It is certified that error appears in the above-identified patent and that said Letters Patent is hereby corrected as shown below:

Title Page insert item (30),

-- Foreign Application Priority Data
April 13, 2007 (EP) .....07075283.7 --

Signed and Sealed this
Nineteenth Day of November, 2013

Teresa Stanek Rea
*Deputy Director of the United States Patent and Trademark Office*